US006497793B1

(12) United States Patent
Ahonen et al.

(10) Patent No.: US 6,497,793 B1
(45) Date of Patent: Dec. 24, 2002

(54) APPARATUS AND METHOD FOR GRINDING WEBS MADE OF FIBER MATERIAL

(75) Inventors: Heikki Ahonen, Ritvala (FI); Bernhard Dettling, Chatenois (FR)

(73) Assignee: IDI Head Oy, Ritvala (FI)

( * ) Notice: Subject to any disclaimer, the term of this patent is extended or adjusted under 35 U.S.C. 154(b) by 0 days.

(21) Appl. No.: 09/744,359

(22) PCT Filed: Jul. 22, 1999

(86) PCT No.: PCT/FI99/00638

§ 371 (c)(1),
(2), (4) Date: Feb. 16, 2001

(87) PCT Pub. No.: WO00/08255

PCT Pub. Date: Feb. 17, 2000

(30) Foreign Application Priority Data

Jul. 22, 1998 (FI) ..... 981651
Jan. 15, 1999 (FI) ..... 990074
Jun. 3, 1999 (FI) ..... 991269

(51) Int. Cl.[7] ..... D21H 25/00

(52) U.S. Cl. ..... 162/361; 162/286; 162/204; 26/28; 451/184

(58) Field of Search ..... 162/109, 120, 162/136, 194, 196, 197, 204, 205, 206, 222, 224, 286, 287, 288; 26/27, 28; 451/183, 184; 493/361, 362

(56) References Cited

U.S. PATENT DOCUMENTS 348,417 A * 8/1886 Rich et al. ..... 451/183
2,053,778 A * 9/1936 Platt ..... 26/28
2,349,704 A * 5/1944 Clark ..... 162/231
4,012,815 A * 3/1977 Benzaquen ..... 26/28
4,089,738 A * 5/1978 Kankaanpaa ..... 162/206
4,645,484 A 2/1987 Niske ..... 493/362
4,814,043 A 3/1989 Rausing et al. ..... 162/286
5,218,747 A * 6/1993 Riedel ..... 26/28
5,328,716 A * 7/1994 Buchanan ..... 427/121
5,392,499 A * 2/1995 Bertoldo ..... 26/28
5,459,911 A * 10/1995 Iwami ..... 26/28
5,533,244 A 7/1996 Wadzinski ..... 29/90.1
5,815,896 A * 10/1998 Dischler ..... 26/28

FOREIGN PATENT DOCUMENTS

WO 98/46829 10/1998
WO 99/35334 7/1999

OTHER PUBLICATIONS

U.S. Standard Sieve Sizes.*

* cited by examiner

*Primary Examiner*—Steven P. Griffin
*Assistant Examiner*—Eric Hug
(74) *Attorney, Agent, or Firm*—Smith-Hill and Bedell

(57) ABSTRACT

Apparatus and method for grinding levelling of paper, cardboard or a similar continuous web manufactured from vegetative based fibrous raw-material, said apparatus comprising a plurality of grinding means such as rolls or belts preferably arranged on both sides of the web, said means being deviated from the moving direction of the web or the web being deviated from these by means of squeeze rolls and which rolls are characterised by being trioelectrically charged with a similar electrical charge as the ground surface. The web tension can be regulated by moving the grinding means or the web from its direction of movement and the dust generated at the grinding is removed by a vacuum system.

93 Claims, 5 Drawing Sheets

APPARATUS AND METHOD FOR GRINDING WEBS MADE OF FIBER MATERIAL

The present invention concerns an apparatus and equipment for grinding of paper; cardboard or similar continuous webs made of fibrous raw material.

The invention also concerns a grinding method.

The present invention relates to treatment of paper and cardboard and similar fibre-based webs, in particular by grinding one or both sides thereof. In our earlier patent applications, PCT/FI98/00341 and FI 980044 we have dealt with the advantages obtainable by grinding of paper surfaces and by means of which it is possible partially or totally to substitute the calendering used for smoothening of the surface without impairing the strength properties of paper and cardboard and without deteriorating opacity. We have also shown that it is easier to attach various coating layers to a ground surface and that similarly a coating polymer film is more easily attached to a ground surface than to a conventional surface. This is, e.g., because fibrils are released from the surface fibres of the web, whereby there is formed a very fine fluff on the surface which increases the surface available for attachment of the coating pigments. Typically, the surface coarseness of paper and cardboard is about 6 microns and by grinding it can be reduced to even one micron. Since the internal structure of the paper is not compressed, the stiffness and strength properties are preserved and, in some cases, even improved by 10%. Coarsed or risen fibres are nearly completely removed. This is important for the manufacture of, e.g. liquid container cardboard and corresponding coated packaging material.

In principle, grinding can be carried out in many different ways. Thus, it is possible to use a grinding belt or a grinding roll, which is coated with an abrasive or grinding agent, or a grinding stone. These solutions represent purely mechanical grinding processes. It is also possible to grind by using different pigments which simultaneously or later on are used for coating for example by wedging pigments at great speed against the paper web.

If, however, the aim is to achieve grinding by simultaneously subjecting the paper surface to calibration, a belt or roller grinder or a grinding stone are the only alternatives worth considering. The essentially most advantageous of these are the grinding rolls or sets of grinding rolls.

A problem associated with the known wood grinders is that they become clogged or blocked by the wood resins together with hemicelluloses and possibly lignin and in combination with the fine dust formed during grinding. If grinding is too effective, the surface temperature of the web becomes too high which gives rise to the above mentioned clogging. It is important to regulate the grinding pressure also so that it becomes possible to remove only a part of the surface layer of the web without otherwise damaging the web.

The present invention aims at eliminating the problems of the prior art and to provide a completely novel kind of technical solution for grinding of paper and cardboard webs and similar continuous, fibrous webs.

The present invention is based on the idea that the grinding material is selected in such a way that the grinding particles, i.e. the particles on the surface of the grinding roll or belt, become charged and they provide triboelectrically the removed paper dust or fibres with a charge that is the same or which is close to the charge adopted by the fibres. Paper is always slightly negatively charged during brusing, rubbing and grinding. By contrast, it may be mentioned as an example that asbestos fibres always become strongly positively charged.

A second and very important finding of the invention is that the grinding pressure can be more easily arranged by subjecting the web to tension by using stretch rolls or by arranging a different stretching angle between each grinding roll and the paper and by further regulating the inherent tension in the paper. A cascade of rolls or a belt grinder are more advantageous, because it is rather difficult exactly to calibrate the dimension and shape of one grinding means, and the errors of the preceding grinding means can be levelled by the following grinding means.

Aluminium oxide, beryl and many other aluminium oxide compounds also become negatively charged. In connection with our tests we have surprisingly found that, when this is the situation, grinding dust and fibres and fibrils released from the surface fly away from the ground surface and the ground surface does not become clogged when wood-free webs are being treated. This is also true for surface sized papers when the surface size used comprises known alkyl ketene-dimers, anhydrides of alkyl succinic acid and/or starch or cationized starch and combinations thereof. All of these will become electrically charge and fly away from the surface, whereby it is simple to remove them by suction produced by, a vacuum extractor close to the grinding roll. Due to electrical charging, the dust is so strongly released and removed that there are no dustings problems in the environment.

For wood-free papers complete triboelectric cleaning can be obtained with aluminium oxide ($Al_2O_3$) or a corresponding grinding surface.

Identical results have also been reached with papers made partially from wood-containing fibres or from chemical pulp which still contained residual lignin. The grinding rolls were not contaminated and the interstices between the grinding particles were not blocked during testing which involved running over 40 km of different papers through a grinder. It should, however, be emphasised that for wood-containing papers or for papers containing resins and polymers the other methods described in the present invention may become necessary.

The matter was studied also by using coloured papers, whereby it was found that the papers having coloured fibres did not at all change the colours of the grinding rolls.

Since the hardness of alumina on the Mohs scale is 9 and, e.g. that of beryl ($Al_2Be_3SiO_{18}$) is 8, beryl powder is a very suitable additive for alumina because then the wear of the grinding pigments becomes uneven and the grinding surface becomes self-sharpening when the wear of the grinding surface progresses. Any additive or binding agent softer than alumina is suitable provided that it does not make the grinding layer electrically conducting. The following examples of additives of said kind can be mentioned: titanium dioxide and iron oxide. It is also possible to use mixtures of said compounds but only to the extent that the electrical resistivity of the grinding layer is not essentially lowered.

The grinding surface of all grinders is continuously slightly worn, and consequently the worn surface takes up less and less material from the material which is subjected to grinding. This makes it possible, and this is also an essential feature of the present invention, to make each worn grinding roll the last roll of the grinding roller cascade when there are 2 to 8 successive rolls in use. The first two rolls will do most of the grinding of, e.g., the paper surface and the next ones will grind less and less. The rollers following the two first rollers will subject the paper surface to removal of fibres and fibrils, and after said rollers the surface of the ground paper contains less released fibres than a completely untreated raw paper. A paper surface ground with a number of rolls exceeding two is free from risen fibres and fibrils to a larger extent than even a conventional sized surface. This feature is readily comprehended by the paper makers.

According to the present invention an apparatus is therefore used which comprises a plurality for grinding means which are in a deviated position from the straight direction of motion of the web and which can be contacted with the web. The grinding means are fitted in such a way that they can be moved transversally towards the web and away from the web in order to regulate the web tension and, thus, the effectiveness of the grinding. Alternatively, the grinding means can be in fixed position, and the web tension is adjusted by mobile rolls or other support means, such as press rolls. Advantageously, there is on an average a maximum of 1.5 microns of material removed with each grinding means.

The surface which has been subjected to grinding can be polished and easily provided with desired patterns, such as micropatterns which can be provided with an identification medium, such as a fluorescent powder. The apparatus according to the present invention also incorporates, in addition to the above-described grinding unit, a post-treatment unit for modification of the surface of the ground surface.

The invention will provide considerable advantages. By means of the invention it becomes possible exactly to separate the desired amount of substance from the surface of a paper or cardboard web. By regulating the grinding pressure the temperature increase and the clogging of the grinding means can be reduced. By controlling the temperature increase it becomes possible to avoid clogging of the grinding surface. In connection with the present invention there are also provided solutions for cleaning of the grinding means, which will provide for rapid and efficient—and even continuous—removal of substance which has been adhered to the grinding surface. The surface of the web becomes extremely even, because the grinding means will remove material from the highest (thickest) portions of the web. The levelling effect is of a different kind than in calendering in which the thickest parts of the web are compressed together and the density of the web increases more at these portions than at the thinner portions. The microcoarseness of the surface fibres of the web improves the result of coating carried out subsequent to grinding and bonds the coating particles to the web by forming a larger bonding surface while still removing the loose fibres from the surface.

By combining a post-treatment with the grinding it is also possible to achieve considerable advantages. Thus, the post-treatment of a ground surface is much more easily effected than the post-treatment of the surface which has not been subjected to grinding. The post-treatment can be carried out by methods known per se, such as soft calendering and belt calendering. The post-treatment of the surface can also be effected by other means, such as by pressing into the surface 2 to 10 micron notches or imprints, which can later on be filled with a coating or with another indicator chemical or identification colour. Thus, a pattern is formed on the surface which cannot be seen with the bare eye but which can be identified with fluorescence or another analysis. A normal calendered, smooth surface cannot be subjected to a surface forming method of this kind because the surface will swell when it takes up water and then the even embossing pattern will disappear.

Further processing of the surface can be performed by grinding in such a way that a shaping roll rotates with exactly the same speed as the web and grinds the surface by vibrating in the directions of the x, y or z axes.

Next the invention will be more closely studied with the aid of a detailed description and with reference to the attached drawings.

In the following description, "web tension" stands for the tension caused by the friction generated by a grinding means, e.g. a roll, and not only the external web tension which is achieved by the means conveying the web forward.

Figure 1:
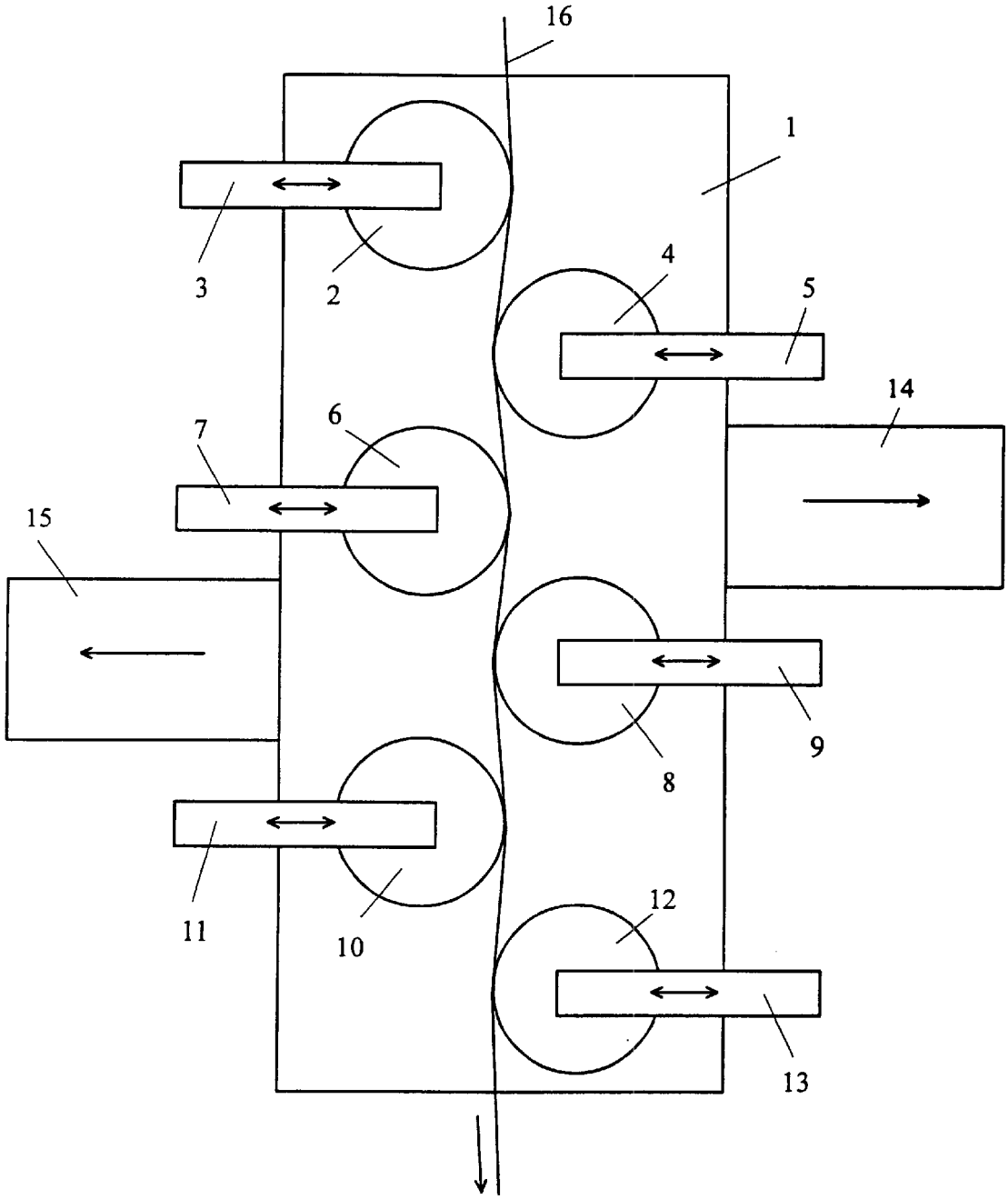
FIG. 1 gives a side-view of the construction of a first preferred embodiment of the apparatus according to the present invention.

FIG. 1 depicts the basic embodiment of the present invention according to which a web 16 is ground by a roll grinding device 1–15. The apparatus comprises a set of rolls fitted to a frame 1, the axes of the rolls 2, 4, 6, 8, 10 and 12 being pivotably mounted to rails 3, 5, 7, 9, 11 and 13 adapted for moving the rolls transversally towards the web and away from the web. The longitudinal axes of the rolls 2, 4, 6, 8, 10 and 12 are at least essentially parallel and essentially horizontally adapted. In the case according to FIG. 1, the rolls are alternately arranged on opposite sides of the web. By moving the rolls transversally against the web the apparatus can be controlled and, at the same time, the web tension can be adjusted. The movement of the rolls can be carried out by any actuator and operative mechanism such pneumatic and hydraulic cylinders and electric motors. The direction of movement of the rolls does not have to be transverse to the web but the rolls can be moved for example by turning the shafts obliquely or along a circular path with relation to the web. The route of the web which is to be treated can differ from the, on an average, straight line depicted in the example and it can be achieved as desired depending on the used grinders. By the movements of the rolls it is also possible to regulate the grinding distance, in other words, for how long the web runs over the roll shell.

Figure 2:
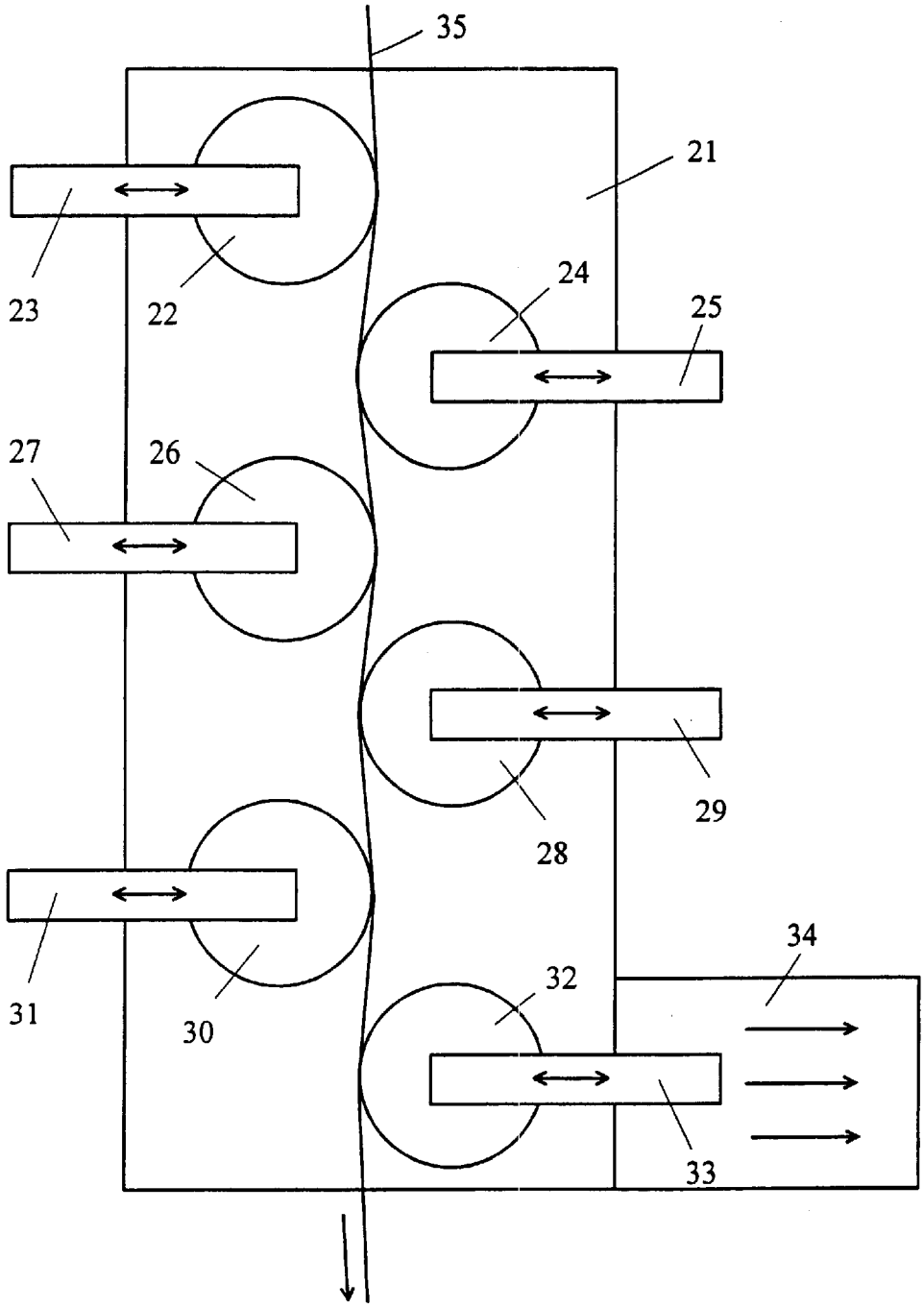
FIG. 2 gives likewise a side-view of the construction of another preferred embodiment of the apparatus according to the present invention.

FIG. 2 shows a construction similar to that of FIG. 1 and which comprises the corresponding mechanical parts (web 35, frame 21, roller set 22–33). In this case also the web tension can be regulated with the rolls.

Regulation of the grinding force can be carried out, for example, by contacting the grinding means with a web having a predetermined web tension and by adjusting the final web tension by regulating the position of the grinding means or by changing the angle between the web and the grinding means. The angle between the tangent of the web and the tangent of the surface of the grinding means is preferably, at the contacting point between the web and the surface of the grinding means, 1 to 35°, preferably about 8–17°.

The apparatuses according to FIGS. 1 and 2 may comprise as grinding means instead of the rollers, also grinding, drums and belt grinding stations. According to a specific embodiment the grinding means comprise;.grinding rollers or drums arranged on one side of the web (e.g. 2, 6, 10; 22, 26, 30) and, on the other side of the web, control rolls (4, 8, 12; 24, 28, 32) arranged along the height of the apparatus between the grinding rolls.

In contrast to the embodiments, shown in the figures, the grinding means of the apparatus can also be provided by fitting grinding rolls or drums on one side of the web and abutting these on the opposite side of the web press rolls which can be rotated in the running direction of the web. The press rolls can be used for reducing the web tension and, thus, for adjusting the grinding result. It should be noted that the web tension can also be regulated by using grinding rolls which are mounted in fixed position and by using mobile support means, such as press rolls for bringing the web against the surface of the fixed rolls.

We have found that the grinding surface of the grinding device can, at certain conditions, be kept clean and, at other conditions, it will become clogged. This is an essential finding behind the construction of the present apparatus and the present invention. When paper containing wood fibre is being ground this fibrous material contains, depending on the wood species, pitch and resinous substances having a softening point or melting point in the range of 65 to 75° C. When the paper is cellulosic paper, i.e. it contains chemical cellulosic pulp, there are essentially no pitch or resinous substances in the paper but some lignin having a glass transition point of, typically, 124° C.

The above-described sets of rollers are used so that the grinding could be carried out without locally exceeding said temperatures at the grinding surface. Thus, with one grinding device there is removed from the paper or fibrous web preferably about 0.5 to 1.0 microns of material for one grinding operation i.e. each time the web passes a grinding device. The maximum grinding amount is preferably about 1.5 $\mu$m. In other words when more material is to be removed, there has to be used a corresponding greater amount of grinding means or grinding rollers for grinding of the same side. Further, in order to ensure that, for example, the grinding roll does not heat up too much it is preferred to use internal or external cooling (cf. below) for adjustment of the temperature of the grinding medium. The grinding means can be manufactured to different surface coarseness levels whereby, preferably, the coarseness of the surface decreases in the moving direction of the web. As an example it can be mentioned that the coarseness of the first roller can be about 10 $\mu$m and the roll be coated with abrasive particles having an initial particle size distribution of 20 to 45 $\mu$m. The coarseness of the roll or rolls of the second stage can be about 8 $\mu$m, and the roll be provided with abrasive particles having a particle size distribution of 15 to 30 $\mu$m and the coarseness of the third stage can be about 5 to 6 $\mu$m, and being formed by particles having a size distribution of about 5 to 25 $\mu$m. Similarly, the angle between the web and the surface of the grinding means can be increased in order to make the grinding more efficient. Typically the angle increases for each grinding means. With a plurality of grinding means it is possible efficiently to remove fibre coarsing and fibres loosely bound to the surface.

In the preferred embodiments of FIGS. 1 and 2, two or three rotating rolls are needed for grinding of one surface of the paper. The rolls can be rotated in the opposite direction to the moving direction of the paper. The rotational direction can be reversed when the web is initially conveyed through the grinding device. It is possible to have the rolls rotating in the direction of the web movement, it is essential only that there is a speed difference between the web and the grinding means.

Preferably, in the grinding device according to the present invention the velocity difference between the grinding means, i.e. the roll, drum or belt, and the fibrous web which is being subjected to grinding should be sufficiently large to make the surface pressure as small as possible so that the apparatus does not tear away intact fibres from the paper. The apparatus should wear down and fibrillate the fibres on the surface to small particles. It is important that these particles be recovered and they can be used as a binder, as absorbant or for coating of the same paper again.

The abrasive powder on the surface of the grinding means has a particle size of preferably about 10 to 40 microns. The abrasive agent may comprise, e.g., alumina, diamond. tungsten carbide, silicon carbide, silicon nitride, tungsten nitride, boron nitride, boron carbide, chromia, titania, mixture of titania, silica and chromia or a mixture containing two or more of these compounds. The grinding material is preferably selected such that the particles of the grinding surface takes up a triboelectric charge which is the same or which is close to the charge adopted by released paper dust or fibres. Paper always becomes slightly negatively charged which it is brushed, rubbed or ground. As an opposite example, reference can be made to asbestos fibres which always become strongly positively charged. Materials of the above kind are, e.g. aluminium oxide, beryl and many other aluminium oxides. When grinding was carried out using materials of the above kind, grinding dust and fibres and fibrils liberated from the surface fly away from the ground surface. The surface does not become clogged and it is easy to recover the dust.

The abrasive powder can be attached to the grinding surface electrolytically or by thermal spraying or it is attached by gluing to form an even layer by using a gluing resin, such as phenolic resin or epoxy resin or mixtures thereof or a suitable rubber composition. The grinding surface can also be comprised of an edge in the surface of a roll which grinds the bent paper either due to the action of a suitably shaped cutting edge or due to a specific form of the edge. The edges can be made for example by milling grooves into the roll and then making the roll smooth by grinding so that the edges of the necks between the grooves become sharp. It is also possible to burn a dense pattern of grooves which are parallel with the axis of the roll, whereby the edges of the burning marks become rough. This kind of surface can be made suitable for grinding by grinding down the surface of the roll to calibration dimensions so that there is left a rough cutting edge.

According to a preferred embodiment of the present invention the velocity of the grinding means, i.e. the roll or belt, in relation to the velocity of the web which is subjected to grinding is such that the minimum velocity difference is exceeded which changes the grinding in so that it provides cutting action and it does not tear away the fibres. This means that at high web speed the roll or grinding belt does not have to rotate at very high speed because the velocity of the web will provide for a great velocity difference. The velocity of the grinding means is limited by the requirement that the grinding surface contacting the web should be changed quickly enough so that the dust between the grinding surface and the web can be removed and so that the grinding means will obtain sufficient air cooling from the air stream. Based on our findings the velocity difference should be at least 200 m/min, preferably over 250 m/min. a greater velocity difference is always more advantageous as regards the grinding result, but an unnecessary high velocity at the grinding belt or grinding roll will cause, e.g., vibration problems. In order to avoid the risk of the grinding dust being ignited the surface velocity of the grinding means should be kept so high that irrespective of the velocity difference the temperature at the grinding point does not exceed 100° C. The heat generation is naturally dependent on the specific fibrous web which is being ground and the grinding pressure.

It is preferred to cool each roll and immediately to blow or adsorb the grinding dust so that it will not adhere to the ground surface. These two alternatives are depicted in FIGS. 1 and 2. In FIG. 1 there is depicted a situation in which dust is suck away with reduced pressure via vacuum nozzles 14, 15. In FIG. 2 there is depicted how air can be blown from a pressure air pipe towards the roll or drum in order to cool down the surface of the roll and to blow away the dust 34. In particular, the strong air current is conducted from the pressure air pipe against the rotational direction of the roll or drum.

Figure 4:
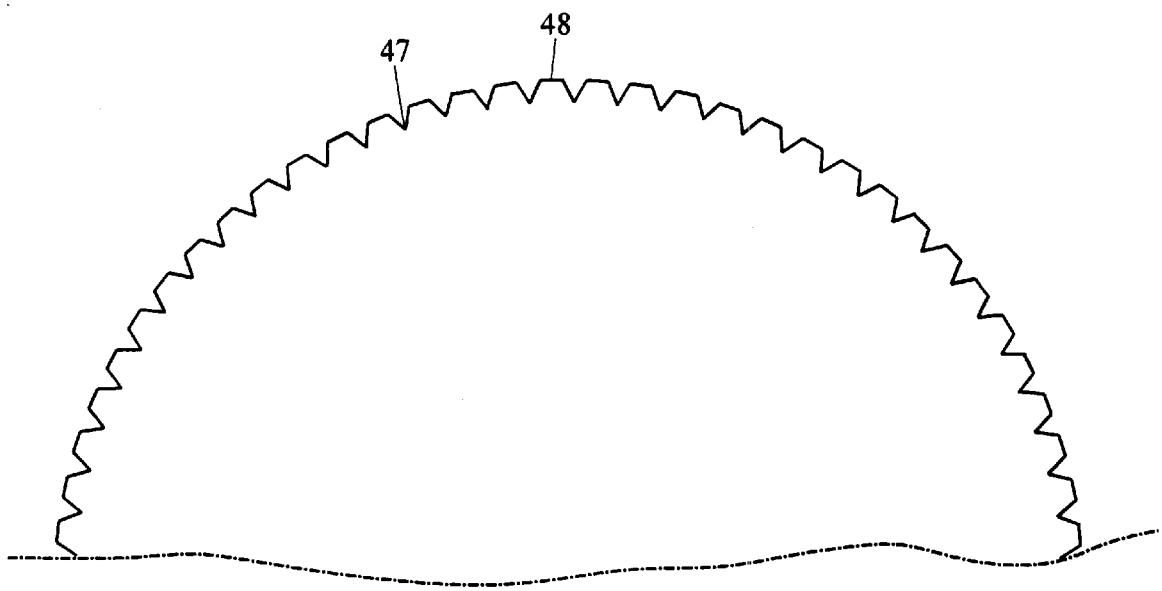
FIG. 4 depicts the shape of the surface of one grinding roll.

The surface of the grinding roll or drum can be provided with openings which are connected to a vacuum source and through which the substance released from the ground web can be conveyed away. It is preferred also to provide the grinding roll or drum with grooves so that only the portion comprising the neck between the grooves is made more coarse with particles, whereby that portion carries out the grinding and the intermediate groove collects the grinding dust. In this way the grinding surface does not become dusty and it is not clogged as easily as a continuous grinding surface. A similar groove system also works as a cooling part. FIG. 4 schematically depicts the form of one roll provided with grooves. In this embodiment, the surface of the roll comprises V-shaped grooves 47 with intermediate grinding necks 48, which may be coated with an abrasive agent or its surface can be machined with a grinding pattern.

Figure 3:
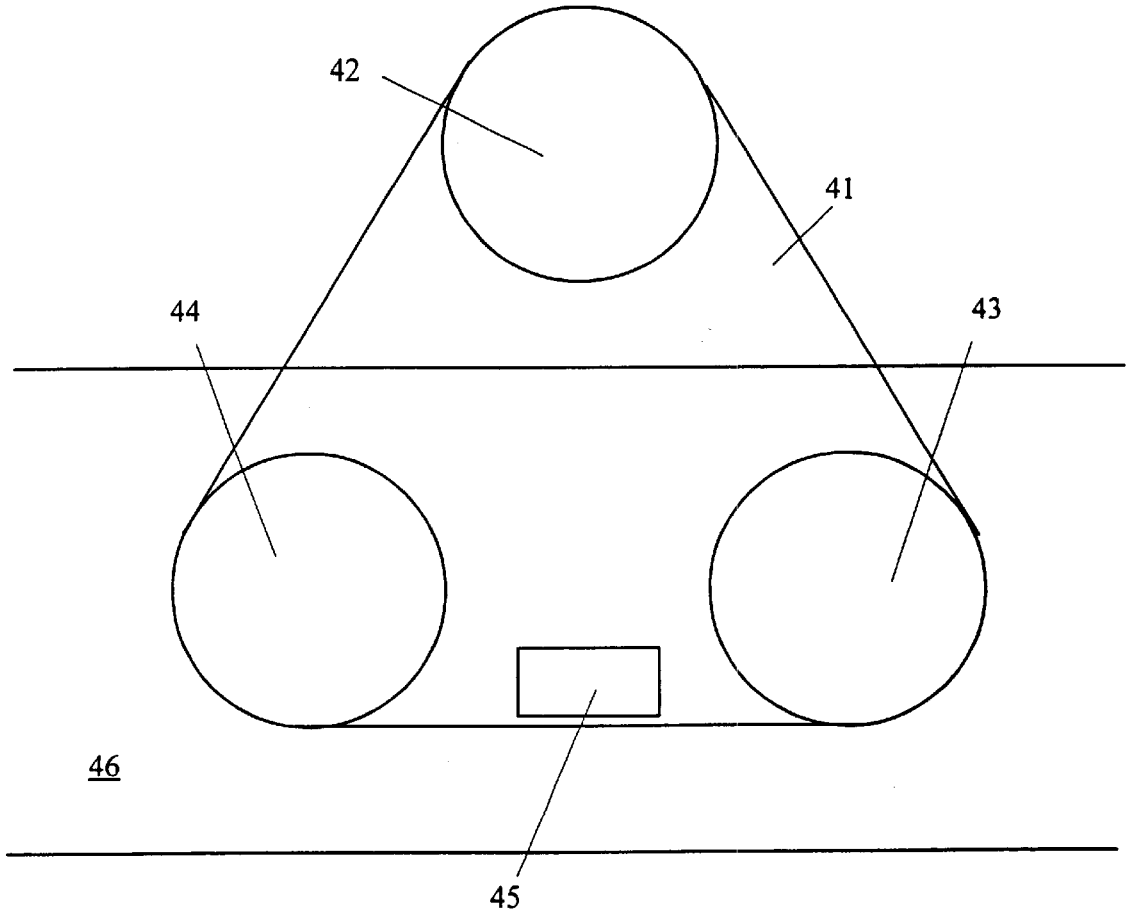
FIG. 3 shows, in side-view, the principal construction of a grinding belt construction used as a grinding means.

As a grinding means, also a grinding belt (cf. FIG. 3) can be used. Preferably a metal belt 41 is used which is rotated on rolls 42 to 44 and which is coated with abrasive particles. To keep the belt clean it can be adapted at least periodically to run in a water bath 46 and an ultrasonic source 45 is fitted into the water bath for directing radiation within the ultrasonic range against the belt.

The grinding roll or grinding belt can preferably be formed by subjecting a metallic surface which has been made smooth by grinding or rounding off to electrolysis by using the grinding means as an anode. At different voltages and difference compositions of the electrolyte, a pattern of desired shape can be etched into the surface, the edges of the pattern working as grinding edges. The electrolysed surface can be hardened or the electrolysis treatment can be made to a hardened surface.

Roughening by electrolytic etching can be made, for example, in the following way: A piece of stainless steel is placed in an electrolyte which contains 7 g/l soda and 2.5 g/l NaOH and a distance of 15 mm is being used between the anode and the cathode and a voltage of the magnitude of 12 V. Thereby a surface completely covering the original surface full with almost completely hemispherical notches having a size of 0.1 to 0.3 mm and with entirely sharp edges is achieved. In this method it is essential that the electrolytic voltage is large enough so that an uneven etching is be initiated. The voltage should therefore be greater than the voltage used for the provision of an even electrolytic coating.

An electrolytically manufactured grinding surface is particularly well suited to the grinding of paper surfaces when the surface contains a large amount of fibres which protrude from the surface because of some other grinding operation or because of the paper's original properties, the holes in the grinding surface cutting the fibres like a razor's edge and not like a cutting edge. This kind of a surface is particularly preferred as a last grinding surface because it very efficiently levels off the surface by cutting protruding fibres.

By means of the present invention it becomes possible to make certain that the grinding device is not clogged in the following way: When a grinding surface is becoming clogged at some part this part usually generates more heat and the clogged place begins to grow and it forms e.g. on a grinding roll or a grinding belt a clogged parallel strand which has a tendency of further growing. This holds true in particular for grinding of wood-containing paper or cardboard qualities. This kind of clogging can be removed during grinding from the surface of the roll or belt by a strong burst of light just as Polycon Industries. U.S.A. remove paint from, e.g., boat surfaces with a strong Xenon-lamp.

The grinding surface can also be cleaned with a surface containing an adhesive glue which releases the particles from the grinding surface when the glue surface is pressed against the grinding surface and then released therefrom. A surprising finding was that a surface formed from $Al_2O_3$ abrasive particles did not itself attach to the adherent glue (e.g. a styrene butadiene- or acrylic adherent glue) nor did the adherent glue adhere to said grinding belt.

When the grinding means comprised a grinding means made from metal (e.g. a roll or belt coated with abrasive agent), the apparatus can be provided with an inductive heater for heating of the grinding means. In this case, a pressure air pipe is preferably combined with the apparatus, so that an air stream can be conducted towards the heated grinding means for removing the dust released during heating. A metal surface or a surface coated with electrically conducting materials, such as chromium dioxide or titanium oxide can be cleaned electrolytically by using the grinding means as the cathode pole of electrolysis, the gas bubbles generated on the cathode blowing away the material accumulated in the openings of the abrasive particles.

Most preferably, the substance used for forming the grinding surface comprises a material which becomes triboelectrically charged with the same charge as the paper dust or paper fibres or with a charge similar to that taken up by the fibres. Thereby the particles and other material released during grinding will repel the grinding surface and fly away from the surface and the surface automatically is kept extremely clean. In a solution of this kind it is not necessary to use other cleaning means or the need for cleaning is at least essentially smaller than when other kinds of grinding materials are used. As already mentioned above, triboelectrically suitable materials are, e.g., aluminium oxide, beryl and aluminium oxide compounds. The material released from the grinding surface can be collected with a simple suction device. Preferably, parts and piping of the suction are manufactured from an electrically non-conducting material, e.g. plastic, preferably a PVC plastic.

The condition of the grinding surface of the grinding device can preferably be monitored by using a laser beam. From a normal, clean grinding surface the laser beam is reflected at the typical reflection angles of the abrasive particles in a specific reflection pattern which is dependent of the coarseness and character of the specific abrasive particle. Immediately when the grinding device is beginning to become clogged or it looses some of its grinding properties for some other reason, the character and amount of this reflection pattern change, the changes can be automatically and immediately discovered and suitable corrective measures can be taken, e.g. by removing the components causing the clogging from the grinding device or by changing the grinding device to a new one while the previous is being subjected to regeneration.

In order to make the grinding action of a belt or grinding roll more efficient and in order to clean the grinding surface it is possible continuously or intermittently to add fine pigment which binds the grinding dust and keeps the grinding surfaces clean.

The source of laser or another light whose reflections are used for monitoring the cleanness of the grinding surface should have a wave length below that of red light, otherwise the surface formed by fine, 10 to 30 micron particles does not give sufficient scattering of the monitoring light. It is possible to monitor with a laser beam a surface only when the wave length of the laser beam is less than twice the particle size. Then the clogged surface and the clean surface give a different reflection in the direction of the beam. In this case the direction of the beam should be almost the same as that of the grinding surface. The direction of the beam should not deviate from the direction of the surface more than 0.5 to 3 degrees.

Figure 5:
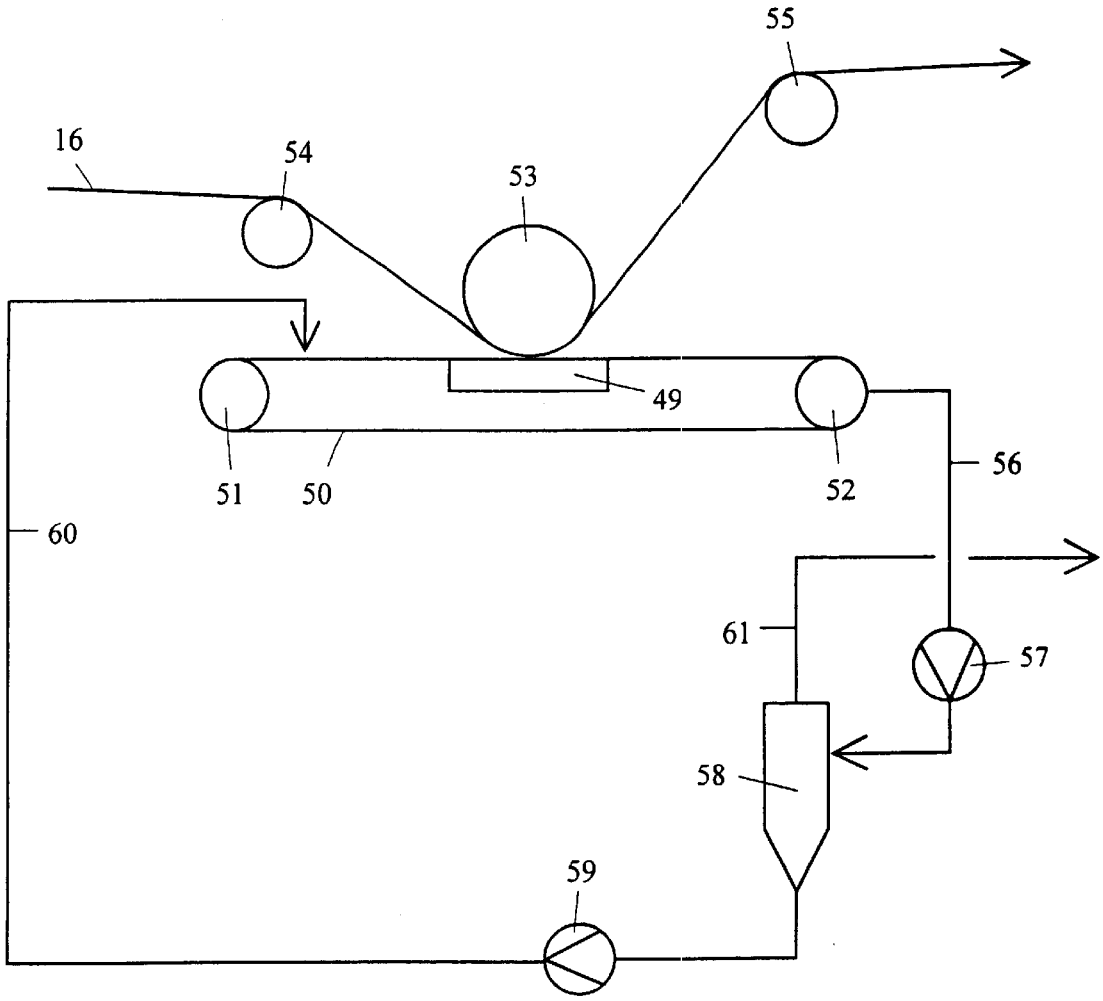
FIG. 5 indicates the form of a device used as a grinding means.

In addition to the above described embodiments, there are also other embodiments:

The grinding material does not necessarily have to be fixed to the grinding surface. FIG. 5 shows an apparatus in which a magnetic abrasive agent is fixed by a magnet 49 during the grinding operation on the surface of an endless belt 50. The abrasive agent can be any sufficiently hard magnetic powder, such as iron, steel magnetite, cobalt, nickel or a mixture of these or a mixture of other known magnetic compounds. The grinding device comprises said belt which can be manufactured from metal or a polymer material or from another suitable material which can be manufactured into an endless belt having an even surface. The belt material'should not be magnetic so that the belt does not become altogether magnetised. Belt 50 travel is guided by rolls 51, 52 and between rolls 51 and 52 on the inside of the belt loop there is placed a magnet 49. On the outside of the belt loops on the opposite side of the magnet, there is a counter roll 53 and the treated web 16 is guided past the counter roll 53 with the aid of guide rolls 54, 55. The counter roll 53 can be fitted so close to the belt 50 that the web 16 running past it can be pressed against the belt. The belt 50 can be run at desired velo city to achieve desired grinding effect and the velocity of the belt preferably differs from the velocity of the web 16.

The grinding dust and the abrasive agent is collected with the aid of a suction device 56 placed in the moving direction of the belt 50 after the magnet. The suction device is attached to a blower 56 which produces reduced pressure and which feeds the abrasive agent and the dust to a cyclone separator 58. Instead of a cyclone separator it is possible to use magnetic separation or another suitable separation method. The abrasive agent is recirculated to the belt by using the blower 59 via line 60 and the dust is removed via line 61. The recovery of the fine material can be made more efficient by using a magnet placed at the separation point or by using a suitable, directed air stream.

The grinding force and web tension can be adjusted so as to suit the grinding by means of, for example, the following methods: First, the grinding force can be adjusted by moving the grinding means and the means guiding the web (4, 8, 12) to their initial positions, whereby the web adopts an initial tension, and then the final grinding force and web tension are set by conventionally adjusting the web tension by using the pulling devices pulling the web. Second, it is possible to set the grinding force by conventionally adjusting the web tension to an initial value by using the web pulling means for adjusting the web tension, and then setting the final web tension and grinding force by adjusting the position of the grinding means (2, 6, 10) and the web guiding means (4, 8, 12). The web tension can be measured by using conventional tension measuring devices.

The further processing of the ground surface can be carried out either directly on the ground surface or after sizing or light coating of the ground surface. The further processing normally comprises polishing, light calendering or renewed drying of the ground and slightly moisturised surface against a smooth heating surface, or a combination of all these. The polishing unit may comprise a polishing belt which moves at a velocity different from that of the surface which is being polished and which comprises a woven metal and/or polymer cloth. The afore-said smooth heating surface may comprise a smooth cylinder or a smooth, heated belt.

The web can be brought to an embossing treatment either directly or after the afore-mentioned preferred grinding step. During the embossing step the surface is shaped by pressing or grinding thereto a desired, regular pattern, which contains for example microimprint. The imprint can be filled with an identification agents, such as a fluorescent powder.

The further processed surface shape is particularly suitable as a raw material of security papers, such as bank-note paper. However, it is possible to provide even other paper and cardboard products by surface forming of the ground surface. It is, namely, possible to change the appearance of the surface by forming a continuous regular pattern, which makes it differ from a conventional paper and cardboard web in which the appearance of the surface is based on random variation of the pattern.

What is claimed is:

1. Apparatus for grinding a paper, cardboard or similar moving web of a fibrous raw material based on vegetable fibers, comprising:

a frame, a means connected to the frame for guiding the web along a predetermined path, at least first and second grinding means each having a grinding surface that can be brought into contact with the moving web for generating a grinding force between the web and the grinding surface, and a means for pressing the grinding surface of at least one grinding means against the moving web for adjusting the grinding force between the web and the grinding surface of said one grinding means, the contact length between the grinding means and the web, and the web tension, and wherein the grinding surface of said one grinding means is provided with a coating of a grinding material which, during grinding, takes up a triboelectric charge of the same polarity as particles released from the web during the grinding.

2. The apparatus according to claim 1, wherein the web that is being ground and the grinding surface of said one grinding means can be moved with respect to each other at a relative velocity of at least 200 m/min.

3. The apparatus according to claim 1, wherein the grinding surface of said one grinding means is provided with a coating that comprises aluminum oxide.

4. The apparatus according to claim 1, wherein the grinding surface is provided with a coating that comprises aluminum oxide and another material that is softer than aluminum oxide.

5. The apparatus according to claim 4, wherein the grinding surface is provided with a coating that comprises a mixture of aluminum oxide and beryl, a mixture of aluminum oxide and titanium oxide, or a mixture of aluminum oxide and iron oxide.

6. The apparatus according to claim 1, comprising a pneumatic device on the opposite side of the web from the grinding means for generating an air cushion between the web and the grinding means, for adjusting the grinding result independently of the web tension and the contact length between the grinding means and the web.

7. The apparatus according to claim 1, comprising a post-treatment unit for modifying the surface of the ground web received from the grinding means.

8. The apparatus according to claim 7, wherein the post-treatment unit comprises a polishing station.

9. The apparatus according to claim 8, wherein the polishing station comprises a belt polisher with a polishing belt that can be adjusted for movement at a velocity which differs from that of the treated web.

10. The apparatus according to claim 8, wherein the polishing station comprises a roll with a smooth surface or a smooth belt and a means for heating the belt.

11. The apparatus according to claim 8, wherein the polishing station comprises a web wetting unit or a coating unit for applying water, water vapor or polymer, including cationic or pigmented polymer, to the web.

12. The apparatus according to claim 7, wherein the post-treatment unit comprises an embossing station.

13. The apparatus according to claim 12, wherein the embossing station comprises an embossing means for forming a pattern with imprints on the surface of the ground web.

14. The apparatus according to claim 13, wherein the embossing station comprises a coating means for coating the pattern or for at least partially filling the imprints.

15. The apparatus according to claim 7, wherein the post-treatment unit comprises a soft calender or a belt calender.

16. The apparatus according to claim 1, wherein the means for pressing the grinding surface of said one grinding means against the web presses the grinding surface with a force such that the surface temperature of the web does not exceed a preset temperature limit which for grinding of wood-containing webs is about 65° C. and for grinding of cellulosic webs is about 124° C.

17. The apparatus according to claim 1, comprising a laser device for directing a moving laser ray towards the grinding surface of the first grinding means, whereby weak and clogging of the grinding surface can be determined from the reflection pattern of the laser ray.

18. The apparatus according to claim 1, wherein the grinding surface of the first grinding means comprises an abrasive having a particle size in the range from 5 to 45 microns.

19. The apparatus according to claim 18, wherein the abrasive is attached to the grinding surface of the first grinding means electrolytically or by thermal spraying or it is attached by gluing to form an even layer by using a gluing resin.

20. The apparatus according to claim 1, wherein at least the first grinding means comprises a grinding roll and apertures are formed in the surface of the grinding roll, said apertures being connected to a vacuum source for removing material that is separated from the web by grinding.

21. The apparatus according to claim 1, wherein at least the first grinding means comprises a grinding roll having a surface that is provided with grooves that are essentially perpendicular to said predetermined path and the grinding is effected by abrasive particles implanted on the surfaces of the groove ridges.

22. The apparatus according to claim 1, wherein at least the first grinding means comprises a grinding roll and the apparatus further comprises a pressure air delivery pipe for directing a strong air current towards at least one grinding roll, against the direction of movement of the roll, for cooling the roll and removing dust adhering to the surface of the roll.

23. The apparatus according to claim 1, wherein at least the first grinding means comprises a metal belt coated with abrasive particles.

24. The apparatus according to claim 23, wherein the belt is positioned to run in a water bath and the apparatus further comprises an ultrasonic source fitted in the water bath for directing radiation within the ultrasonic range against the belt.

25. The apparatus according to claim 1, wherein at least the first grinding means comprises a metallic grinding means and the apparatus comprises an inductive heater for heating the metallic grinding means and a pressure air delivery pipe for directing an air current against the metallic grinding means for removing dust released during heating.

26. The apparatus according to claim 1, comprising a flash light source for directing flashes of high energy flash light for removing substance adhered to the grinding surface of the first grinding means.

27. The apparatus according to claim 1, wherein at least the first grinding means is provided with a coating of abrasive particles selected from the group consisting of aluminum oxide, diamond, tungsten carbide, silicon carbide, silicon nitride, tungsten nitrida boron nitride, boron carbide, chromium oxide, titanium oxide, a mixture of titanium oxide, silica and chromium oxide or a mixture containing two or more of these compounds.

28. The apparatus according to claim 1, wherein the grinding surface of the first grinding means comprises metal that has been treated by connecting it as an anode in an electrolytic treatment employing a voltage that is sufficiently high to initiate an uneven corrosion of the surface.

29. The apparatus according to claim 1, wherein the grinding surface of the first grinding means is adapted to cut fibers protruding from the web.

30. The apparatus according to claim 29, wherein at least the first grinding means is an electrolytically made grinding means having a surface that cuts in a razor-like fashion fibers protruding from the web.

31. The apparatus according to claim 1, wherein the grinding surface of at least the first grinding means comprises at least one electrically conducting material and the apparatus comprises an electrolysis apparatus to which the grinding surface of said first grinding means can be connected as a cathode for cleaning by means of gas bubbles formed electrolytically on the cathode.

32. Apparatus for grinding a paper, cardboard or similar moving web of a fibrous raw material based on vegetable fibers, comprising:

a frame, a means connected to the frame for guiding the web along a predetermined path, at least first and second grinding means each having a grinding surface that can be brought into contact with the moving web for generating a grinding force between the web and the grinding surface, the grinding means being successively arranged with respect to said predetermined path, and a means for pressing the grinding surface of at least one grinding means against the moving web for adjusting the grinding force between the web and the grinding surface of said one grinding means, the contact length between the grinding means and the web, and the web tension, wherein each grinding mean is comprises a grinding member arranged on one side of the web and a regulating roll on the opposite side of the web, and the apparatus further comprises a means for effecting relative movement of the web and the grinding surface of each grinding member at a velocity of at least 200 m/min in a direction substantially parallel to said predetermined path.

33. The apparatus according to claim 32, wherein each grinding member comprises a grinding roll.

34. The apparatus according to claim 32, wherein each grinding member comprises a belt grinder.

35. The apparatus according to claim 32, comprising a means for cooling at least the surface of the grinding members.

36. The apparatus according to claim 32, wherein Lie means for pressing the grinding surface against the web press the grinding surface with a force such that the surface temperature of the web does not exceed a preset temperature limit which for grinding of wood-containing webs is about 65° C. and for grinding of cellulosic webs is about 124° C.

37. The apparatus according to claim 32, comprising a laser device for directing a moving laser ray towards the grinding surface of the first grinding means, whereby wear and clogging of the grinding surface can be determined from the reflection pattern of the laser ray.

38. The apparatus according to claim 32, wherein the grinding surface comprises an abrasive having a particle size in the range from 5 to 45 microns.

39. The apparatus according to claim 38, wherein the abrasive is attached to the grinding surface electrolytically or by thermal spraying or it is attached by gluing to form an even layer by using a gluing resin.

40. The apparatus according to claim 32, wherein at least the first grinding means comprises a grinding roll and apertures are formed in the surface of the grinding roll, said apertures being connected to a vacuum source for removing material that is separated from the web by grinding.

41. The apparatus according to claim 32, wherein at least the first grinding means comprises a grinding roll having a surface that is provided with grooves that are essentially perpendicular to said predetermined path and the grinding is effected by abrasive particles implanted on the surfaces of the groove ridges.

42. The apparatus according to claim 32, wherein at least the first grinding means comprises a grinding roll and the apparatus further comprises a pressure air delivery pipe for directing a strong air current towards at least one grinding roll, against the direction of movement of the roll, for cooling the roll and removing dust adhering to the surface of the roll.

43. The apparatus according to claim 32, wherein at at least the first grinding means comprises a metal belt coated with abrasive particles.

44. The apparatus according to claim 43, wherein the belt is positioned to run in a water bath and the apparatus further comprises an ultrasonic source fitted in the water bath for directing radiation within the ultrasonic range against the belt.

45. The apparatus according to claim 32, wherein at least the first grinding moans comprises a metallic grinding means and the apparatus comprises an inductive heater for heating the metallic grinding means and a pressure air delivery pipe for directing an air current against the metallic grinding means for removing dust released during heating.

46. The apparatus according to claim 32, comprising a flash light source for directing flashes of high energy flash light for removing substance adhered to the grinding surface of the first grinding means.

47. The apparatus according to claim 32, wherein at least the first grinding means is provided with a coating of abrasive particles selected from the group consisting of aluminum oxide, diamond, tungsten carbide, silicon carbide, silicon nitride, tungsten nitride, boron nitride, boron carbide, chromium oxide, titanium oxide, a mixture of titanium oxide, silica and chromium oxide or a mixture containing two or more of these compounds.

48. The apparatus according to claim 32, wherein the grinding surface of the first grinding means comprises metal that has been treated by connecting it as an anode in an electrolytic treatment employing a voltage that is sufficiently high to initiate an uneven corrosion of the surface.

49. The apparatus according to claim 32, wherein the grinding surface of the first grinding means is adapted to cut fibers protruding from the web.

50. The apparatus according to claim 49, wherein at least the first grinding means is an electrolytically made grinding means having a surface that cuts in a razor-like fashion fibers protruding from the surface which is to be ground.

51. The apparatus according to claim 32, wherein the grinding surface of at least the first grinding means comprises at least one electrically conducting material and the apparatus comprises an electrolysis apparatus to which the grinding surface of said first grinding means can be connected as a cathode for cleaning by means of gas bubbles formed electrolytically on the cathode.

52. Apparatus for grinding a paper, cardboard or similar moving web of a fibrous raw material based on vegetable fibers comprising:

a frame, a means connected to the frame for guiding the web along a predetermined path, at least first and second grinding means each having a grinding surface that can be brought into contact with the moving web for generating a grinding force between the web and the grinding surface, and a means for pressing the grinding surface of at least one grinding means against the moving web for adjusting the grinding force between the web and the grinding surface of said one grinding means, the contact length between the grinding means and the web, and the web tension, wherein the grinding means comprises a plurality of grinding members that are deflected from the direction of motion of the web and what can be brought into contact with the web, the relative position of the web and the grinding members being adjustable for regulation of the web tension and, thus, of the intensity of the grinding, and the apparatus further comprises a means for effecting relative movement of the web and the grinding surface of each grinding means at a velocity of at least 200 m/min in a direction substantially parallel to said predetermined path.

53. The apparatus according to claim 52, wherein the plurality of grinding members are adapted for movement transversely to the surface of the web towards the web and away from the web for regulating the tension of the web.

54. The apparatus according to claim 52, wherein the grinding members comprise grinding rolls arranged on one side of the web and press rolls arranged on the opposite side of the web, said press rolls being rotatable in the direction of motion of the web.

55. The apparatus according to claim 54, wherein the press rolls can be brought into contact with the web and are adapted for movement transversely towards the web and away from the web for adjusting web tension and, thus, the intensity of the grinding.

56. The apparatus according to claim 52, comprising a laser device for directing a moving laser ray towards the grinding surface of the first grinding means, whereby wear and clogging of the grinding surface can be determined from the reflection pattern of the laser ray.

57. The apparatus according to claim 52, wherein the grinding surface of the first grinding means comprises an abrasive having a particle size in the range from 5 to 45 microns.

58. The apparatus according to claim 57, wherein the abrasive is attached to the grinding surface of the first grinding means electrolytically or by thermal spraying or it is attached by gluing to form an even layer by using a gluing resin.

59. The apparatus according to claim 52, wherein at least the first grinding means is a grinding roll having a surface provided with grooves parallel to the axis of the roll and the grooves have edges that form a grinding edge or an uneven cutting edge.

60. The apparatus according to claim 52, wherein at least the first grinding means comprises a grinding roll and apertures are formed in the surface of the grinding roll, said apertures being connected to a vacuum source for removing material that is separated from the web by grinding.

61. The apparatus according to claim 52, wherein at least the first grinding means comprises a grinding roll having a surface that is provided with grooves that are essentially perpendicular to said predetermined path and the grinding is effected by abrasive particles implanted on the surfaces of the groove ridges.

62. The apparatus according to claim 52, wherein at least the first grinding means comprises a grinding roll and the apparatus further comprises a pressure air delivery pipe for directing a strong air current towards at least one grinding roll, against the direction of movement of the roll, for cooling the roll and removing dust adhering to the surface of the roll.

63. The apparatus according to claim 52, wherein at least the first grinding means comprises a metal belt coated with abrasive particles.

64. The apparatus according to claim 63, wherein the belt is positioned to run in a water bath and the apparatus further comprises an ultrasonic source fitted in the water bath for directing radiation within the ultrasonic range against the belt.

65. The apparatus according to claim 52, wherein at least the first grinding means comprises a metallic grinding means and the apparatus comprises an inductive heater for heating the metallic grinding means and a pressure air delivery pipe for conducting an air current against the metallic grinding means for removing dust released during heating.

66. The apparatus according to claim 52, comprising a flash light source for directing flashes of high energy flash light for removing substance adhered to the grinding surface of the first grinding means.

67. The apparatus according to claim 52, wherein at least the first grinding means is provided with a coating of abrasive particles selected from the group consisting of aluminum oxide, diamond, tungsten carbide, silicon carbide, silicon nitride, tungsten nitride, boron nitride, boron carbide, chromium oxide, titanium oxide, a mixture of titanium oxide, silica and chromium oxide or a mixture containing two or more of these compounds.

68. The apparatus according to claim 52, wherein the grinding surface of the first grinding means comprises metal that has been treated by using it as an anode in an electrolytic treatment employing a voltage that is sufficiently high to initiate an uneven corrosion of the surface.

69. The apparatus according to claim 52, wherein the grinding surface of the first grinding means is adapted to cut fibers protruding from the web.

70. The apparatus according to claim 69, wherein at least the first grinding means is an electrolytically made grinding means having a surface that cuts in a razor-like fashion fibers protruding from the web.

71. The apparatus according to claim 52, wherein the grinding surface of at least the first grinding means comprises at least one electrically conductive material and the apparatus comprises an electrolysis apparatus to which the grinding surface of said first grinding means can be connected as a cathode for cleaning by moans of gas bubbles formed electrolytically on the cathode.

72. A process for grinding a paper, cardboard or similar continuous web of a fibrous raw material based on vegetable fibers, comprising:

(a) contacting the web with a grinding means having a grinding surface and generating a grinding force between the grinding surface and the web, and (b) moving the web relative to the grinding surface of the grinding means, and wherein the grinding means includes grinding particles comprising a material that is triboelectrically charged with a charge of the same polarity as particles released from the web during the grinding.

73. The process according to claim 72, comprising adjusting the web to a selected initial tension value and subsequently adjusting the web tension to a final value by varying the position of the grinding means or the angle between the grinding means and the web.

74. The process according to claim 73, wherein the final value of the web tension is about 30–60% of the breaking force of the web.

75. The process according to claim 72, wherein the web contacts the grinding means in a contact zone and the tangential angle of the web in relation to the surface of the grinding means is in the range 1° to 35°.

76. The process according to claim 75, wherein contact angle is in the range from about 80° to about 17°.

77. The process according to claim 72, wherein step (a) includes vising rotating drive rolls to move the web relative to the grinding means, and the process includes adjusting-the web to a selected initial tension value and subsequently adjusting the web tension to a final value by regulating the rotational speed of the drive rolls or the momentum of the drive rolls.

78. The process according to claim 77, wherein the final value of the web tension is about 30–60% of the breaking force of the web.

79. The process according to claim 72, comprising grinding a side of the web with a plurality of grinding means and removing a maximum of 1.5 microns of material from the web with each grinding means.

80. The process according to claim 72, wherein the tangential angle of the web in relation to the tangent of the grinding surface at the contact point between the web and the grinding surface of the grinding means increases in the direction of movement of the web.

81. The process according to claim 72, comprising feeding pigment together with the web, said pigment being such that it binds to grinding dust released from the web.

82. The process according to claim 81, comprising feeding calcium carbonate, talc, kaolin, silica, aluminum silicate or magnesium silicate together with the web.

83. The process according to claim 81, comprising readherinq the pigment and grinding dist to the web.

84. The process according to claim 83, comprising readhering the pigment and grinding dust to the web by wetting the web or by applying binders to the web.

85. The process according to claim 72, comprising periodically cleaning the grinding surface of the grinding means by directing an air current, ultrasonic energy or high-energy flashes of light towards the grinding surface, or by means of an adhesive belt.

86. The process according to claim 72, comprising employing web conveying means for moving the web relative to the grinding means and the process further comprises adjusting the grinding force to an initial value by moving the grinding means and the web conveying means to initial relative positions and adjusting the grinding force to a final value using pulling apparatus.

87. The process according to claim 72, comprising employing means for moving the web relative to the grinding means and the process further comprises adjusting the grinding force to an initial value using pulling apparatus and adjusting the grinding force to a final value by adjusting relative positions of the grinding means and the web conveying means.

88. The process according to claim 72, comprising polishing the ground paper web.

89. The process according to claim 88, comprising polishing the web using a polishing belt having a speed that is different from the speed of the web, said polishing belt being formed by a woven metal or polymer cloth.

90. The process according to claim 72, comprising polishing the ground web and drying the web with a smooth roll or a heated smooth belt.

91. The process according to claim 72, comprising moistening the ground surface of the web, polishing the ground surface of the web and drying the web.

92. The process according to claim 72, comprising imposing an embossed pattern on the ground surface by embossing or by grinding.

93. The process according to claim 92, comprising forming a regular pattern of imprints on the ground surface and optionally filling the imprints with an identification substance.

* * * * *